US007922349B2

(12) United States Patent
Hunnewell et al.

(10) Patent No.: US 7,922,349 B2
(45) Date of Patent: Apr. 12, 2011

(54) PORTABLE LIGHT

(75) Inventors: Robert C. Hunnewell, Dedham, MA (US); Jonathan M. Craig, Mattapoisett, MA (US); Benoit Devinat, Providence, RI (US); Troy Schubert, Providence, RI (US); Son Long, Cranston, RI (US)

(73) Assignee: GoMotion, Inc., Dedham, MA (US)

( * ) Notice: Subject to any disclaimer, the term of this patent is extended or adjusted under 35 U.S.C. 154(b) by 325 days.

(21) Appl. No.: 12/156,741

(22) Filed: Jun. 4, 2008

(65) Prior Publication Data

US 2008/0316736 A1 Dec. 25, 2008

Related U.S. Application Data

(60) Provisional application No. 60/933,308, filed on Jun. 6, 2007.

(51) Int. Cl.
*F21L 4/04* (2006.01)

(52) U.S. Cl. ..... 362/157; 362/249.02; 362/249.07; 362/249.08; 362/108; 362/103

(58) Field of Classification Search ..... 362/157, 362/249.02, 249.07, 249.08, 285, 287, 103, 362/108

See application file for complete search history.

(56) References Cited

U.S. PATENT DOCUMENTS

| | | | | |
|---|---|---|---|---|
| 4,794,496 | A * | 12/1988 | Lanes et al. | 362/105 |
| 5,224,773 | A | 7/1993 | Arimura | |
| 5,359,501 | A | 10/1994 | Stevens | |
| 5,488,361 | A | 1/1996 | Perry | |
| 5,690,411 | A | 11/1997 | Jackman | |
| 6,056,412 | A * | 5/2000 | Atlee et al. | 362/103 |
| 6,086,213 | A * | 7/2000 | Holce | 362/84 |
| 6,095,657 | A | 8/2000 | Kent | |
| 6,921,181 | B2 | 7/2005 | Yen | |
| 6,959,998 | B2 * | 11/2005 | Tsukamoto | 362/191 |
| 7,153,004 | B2 * | 12/2006 | Galli | 362/373 |
| 7,185,997 | B2 * | 3/2007 | Simoni | 362/108 |
| 2006/0067077 | A1 | 3/2006 | Kumthampinij et al. | |
| 2006/0285314 | A1 | 12/2006 | Barker | |
| 2007/0025102 | A1 | 2/2007 | Yu | |

OTHER PUBLICATIONS

"Peel Sports Launches Accessory Brand," Running Intelligence, Aug. 18, 2008, vol. 3, No. 15, pg. 4.

* cited by examiner

*Primary Examiner* — Sharon E Payne
(74) *Attorney, Agent, or Firm* — Iandiorio Teska & Coleman

(57) ABSTRACT

A versatile, low profile, lightweight, compact, body mounted lighting system includes a housing mountable to a person's body and a light module in the housing. The light module may include at least one LED producing a beam. There is a lens in front of the LED and a mechanism is configured to move the lens to adjust the distance between the lens and the LED to vary the size of the beam.

9 Claims, 10 Drawing Sheets

PORTABLE LIGHT

RELATED APPLICATIONS

This application claims benefit of and priority to U.S. Provisional Application Ser. No. 60/933,308 filed Jun. 6, 2007 incorporated herein by this reference.

FIELD OF THE INVENTION

This subject invention relates to body mounted lighting systems.

BACKGROUND OF THE INVENTION

Body mounted lighting systems are used to provide light as people perform tasks in low light environments. Some lighting systems are head mounted, handheld, or may be mounted on a person's body. See, for example, U.S. Pat. Nos. 6,921,181, 6,095,657, 5,690,411, 5,488,361, 5,359,501, and 5,224,773; and U.S. patent application Nos. 2007/0025102, 2006/0285314, and 2006/0067077.

In today's busy times, daily tasks often cannot be completed during daylight hours. It is increasingly difficult to find daylight hours to enjoy outdoor recreational, commercial, or exercise activities. There exists a strong desire to partake in outdoor activities after nightfall or before sunrise, or to participate in any activities within a dark environment, be it indoors or outdoors.

In the past, outdoor activities had to be performed during daylight hours or were aided by handheld lighting systems, flashlights, headlamps, or environmental lights. The uses of many of these lighting methods are inefficient, cumbersome to use, or do not provide enough light to effectively accomplish the task at hand.

One problem with handheld lighting systems, such as a flashlight, is that one of the operator's hand is occupied while holding the light, making tasks that require two hands difficult to accomplish. Additionally, if using the lighting system while the operator is moving their hands, the lighted area will move as the operator's hand moves. Problems also exist with the use of headlamps. If an operator uses a headlamp the lighting system can become cumbersome for high-motion activities and too hot for comfortable usage. Additionally, providing power to a headlamp is difficult because the power source may be too heavy to mount upon the operator's head. Also, if the operator is engaged in an activity that requires motion, the light field emitted from a headlamp may move as the head moves. Furthermore, headlamps limit peripheral vision due to being mounted so close to the user's eyes. This can create an uncomfortable feeling with the operator as the field of light moves wherever the operator's head moves about the darkened environment. Another method of illuminating an area is using an environmental lighting system, such as floodlights. This method is ineffective if the operator wants to leave the lighted area.

It is not an easy proposition to employ a mobile, body mounted lighting system due to size, power, attachment, and portability constraints. Existing handheld lighting systems require the dedicated use of one hand and do not provide a stable field of light. Headlamps are useful for stationary or relatively slow moving activities but are cumbersome to wear, limit visibility to the small, lighted area directly in front of the operator, and generate heat proximate to the operator. The field of light with headlamps moves with the operator's head allowing the user to see only where their head is directed. Additionally, the power source is often too heavy to comfortably mount to the operator's head. The heat produced by headlamps can cause the housing to become hot and make the operator uncomfortable if in proximity to their head. But, headlamps and flash lights are useful if used in relatively low-motion activities or where only one hand is needed to perform the desired task. Floodlights can provide the desired level of illumination but often are not conveniently portable for mobile outdoor activities like jogging.

Applications of a relatively low profile, lightweight, compact, body mounted lighting system include walking, running, hiking, fishing, boating, kayaking, or climbing in the dark, as well as municipal, military, and general safety use.

BRIEF SUMMARY OF THE INVENTION

It is therefore an object of this invention to provide a new low profile, lightweight, compact, body mounted lighting system.

It is a further object of this invention to provide such a lighting system which operates to provide a stable beam of light for an operator.

It is a further object of this invention to provide such a lighting system which operates to provide a variable beam size.

It is a further object of this invention to provide such a lighting system which allows the user to angle the light beam at different angles.

It is a further object of this invention to provide such a lighting system which has a comfortable interface with the operator's body.

It is a further object of this invention to provide such a lighting system which does not produce high heat levels.

It is a further object of this invention to provide such a lighting system which assists in ensuring the safety of the user.

The subject invention results from the realization, in part, that a novel body mounted lighting system employs a movable lens to adjust the beam size, a heat sink to keep the operator from exposure to excessive temperatures, and a pivotable body to angle the light beam.

The subject invention, however, in other embodiments, need not achieve all these objectives and the claims hereof should not be limited to structures or methods capable of achieving these objectives.

This invention features a versatile, low profile, lightweight, compact, body mounted lighting system. A housing is mountable to a person's body and an LED module resides in the housing. The LED module includes at least one LED producing a beam, a lens in front of the LED, and a mechanism configured to move the lens to adjust the distance between the lens and the LED to vary the size of the beam.

One mechanism configured to move the lens includes a lens carrier for the lens, at least one peripheral tab, and a dial rotatably mounted in the LED module including a spiral track for the tab. In one preferred embodiment, the lens is a Fresnel lens. The LED module may further include a rearward heat sink to which the LED is mounted. The heat sink is preferably constructed of a polymer body with molded rearward fins. The LED module is permitted to be pivotally mounted in the housing to adjust the angle and direction of the beam. The preferred LED module is symmetrical along a longitudinal centerline and the lighting system may further include a power cord for the LED module extending through the housing to the LED along the centerline forming a hinge between the LED module and the cage front. The lighting system power pack can be connected to the power cord and can include at least one rearwardly mounted LED.

In one example, a vest is included with a strap for mounting the housing on the person's body. A channel in the harness is for the power cord and a rearward portion has a pocket for the power pack. The housing can be attached to the body via a sternum strap carrying the housing and securable to the shoulder straps of a pack or a strap carrying the housing and securable to a belt. The vest and belt may include a rearward portion with a pocket for the power pack providing electricity to the LED module.

A low profile, lightweight, body mounted lighting system in accordance with the subject invention features a housing mountable to a person's body and a light module in the housing. The light module may include at least one light source producing a beam. A lens in front of the light source is held by a lens carrier that includes at least one peripheral tab. A dial is rotatably mounted in the light module and has a spiral track for the tab of the lens carrier. Rotation of the lens carrier adjusts the distance between the lens and the light source to vary the size of the beam output.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
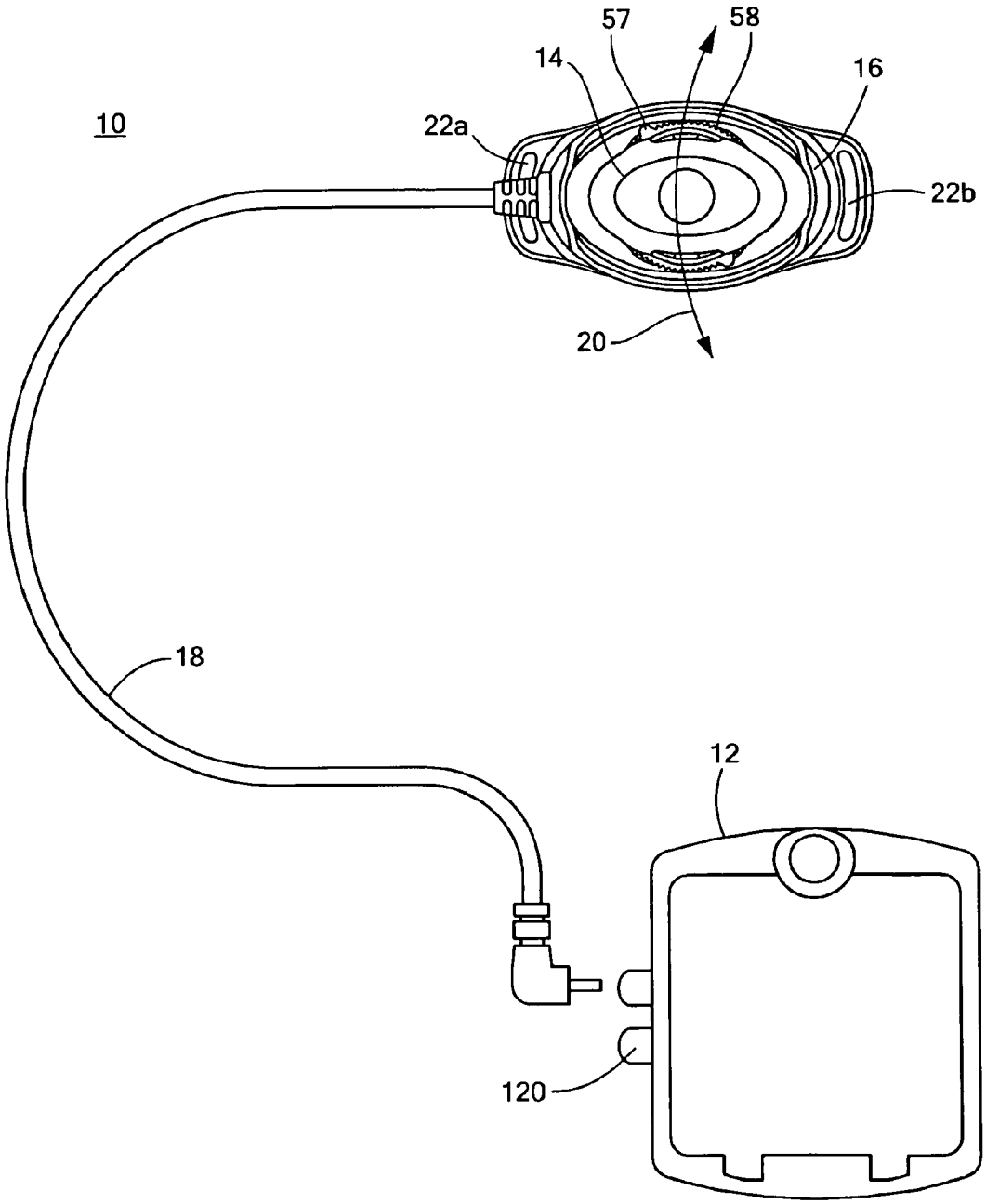
FIG. 1 is a schematic front view of the primary components of a versatile, low profile, compact, body mounted lighting system in accordance with an example of the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 shows an example of a versatile, lightweight, compact, body mounted lighting system 10 in accordance with the subject invention. Battery pack 12 provides power to LED module 14 mounted in housing 16 via cable 18. In accordance with a preferred embodiment of the subject invention, LED module 14 is able to pivot up and down as shown by arrow 20 to vary the angle of the beam of light emitted by LED module 14. Also, housing 16 can be attached to a sternum strap of a vest, the chest straps of a backpack, and/or to a belt by virtue of strap slots 22*a* and 22*b*. Furthermore, adjusting dial 58 causes the size of the beam of light to change. The subject invention is thus highly versatile.

Figure 2:
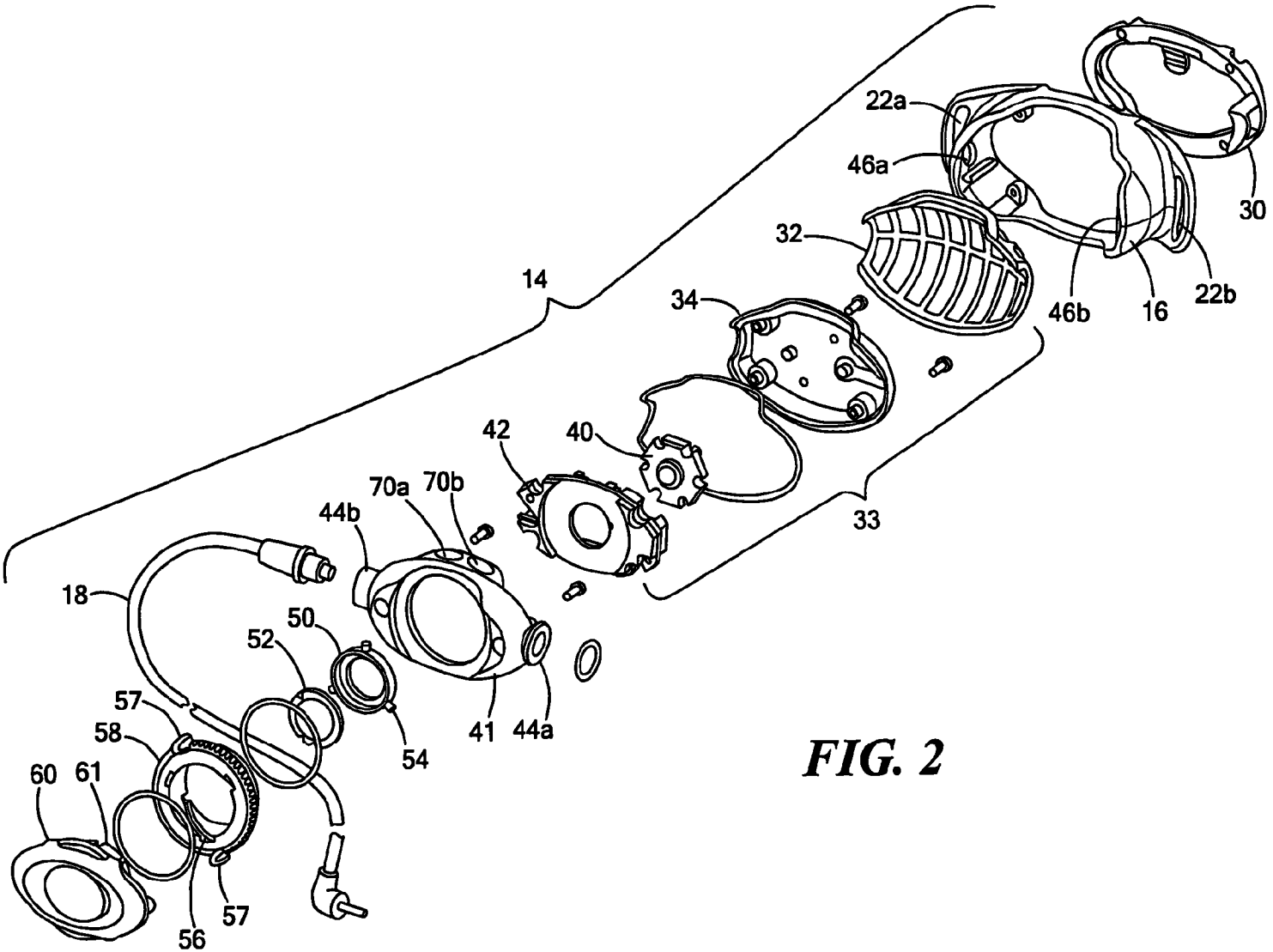
FIG. 2 is an exploded view of the lighting system shown in FIG. 1.

In one example, the LED module includes cage back 30, FIG. 2 coupled to housing 16. Heat sink cage 32 provides ventilation for cooling of the system by allowing air to circulate about heat sink 34 and to remove heat by convection. Heat sink 34 is preferably made of a polymer material (e.g. "Coolpoly" manufactured by CoolPolymers of Warwick, R.I.) and contains molded rearward fins (not shown) to provide sufficient cooling for extended wear. LED module 14 also includes LED 40 mounted to heat sink 34 and within printed circuit board (PCB) assembly 42. Subassembly 33 is mounted to cover 41 including tabs 44*a* and 44*b* received into orifices 46*a* and 46*b* of housing 16 to allow the LED module to rotate within housing 16 to vary the angle of the beam. Tabs 44*a* and 44*b* are on the centerline of cover 41 which allows the rotation to be performed about the central longitudinal axis of the LED module. Power cord 18 enters cover 41 along the central axis and extends through tab 44*b* and orifice 46*a* in housing 16 in order to provide power to printed circuit board 42 and LED 40. Thus, power cord 18 constitutes a component of the hinge assembly between the LED module and housing 16.

LED module 14 also includes lens carrier 50. Fresnel lens 52 is seated within lens carrier 50. Lens carrier 50 includes at least one peripheral tab 54 which rides in spiral track 56 of focus dial 58. Rotation of focus dial 58 causes lens carrier 50 to move lens 52 with respect to LED 40 in order to vary the distance between lens 52 and LED 40 to change the size of the output beam. Paddles 57 included on dial 58 make the dial easy to turn. Front bezel 60 secures focus dial 58, lens carrier 50, and lens 52 within cover 41 and has lateral tracks 61 to maintain lens carrier 50 and lens 52 alignment. LED 40 may be an LED of varying wattage (e.g. 1-watt or 3-watt) or another light source. Other mechanisms for moving lens 52 to adjust the distances between lens 52 and LED 40 to vary the beam size are with the scope of the subject invention. Additionally, although a LED is described, other light sources may be used in other embodiments of the subject invention.

Figure 3:
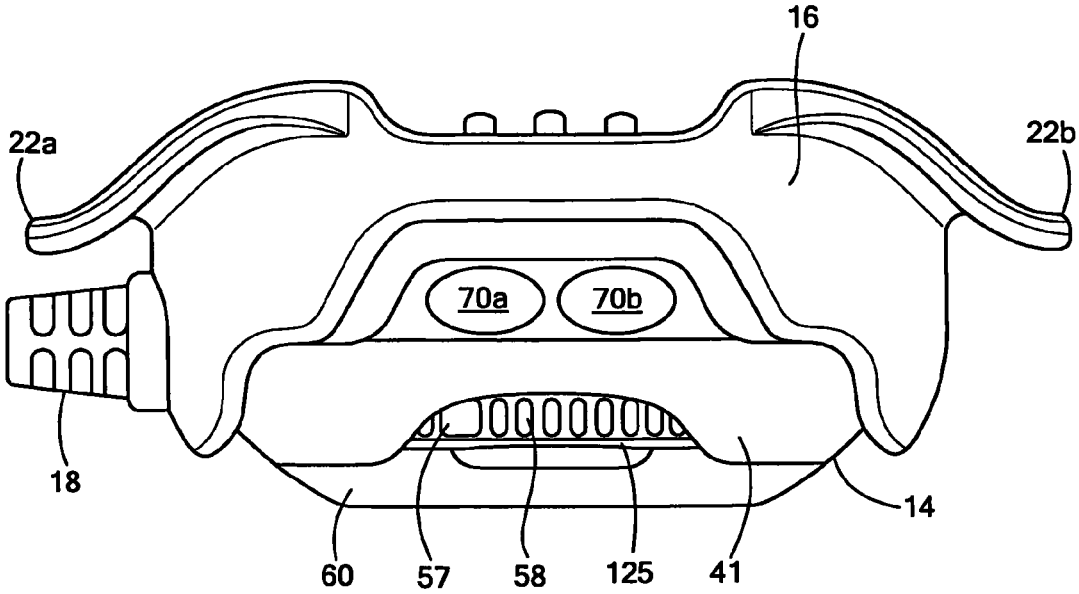
FIG. 3 is a schematic top view of the lighting system of FIG. 1.
Figure 8:
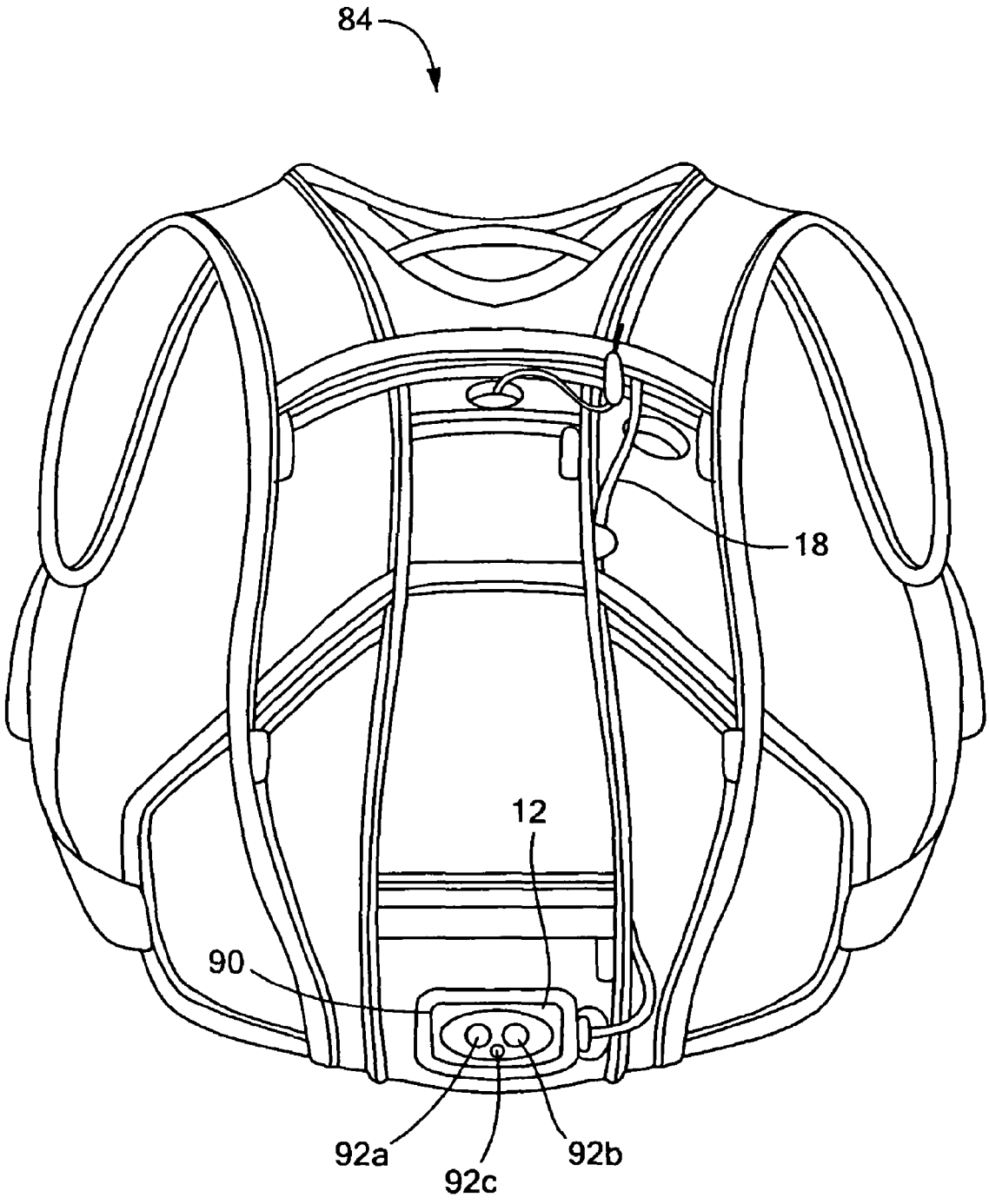
FIG. 8 is a schematic rear view of the torso-mounted vest of FIG. 7.
Figure 11:
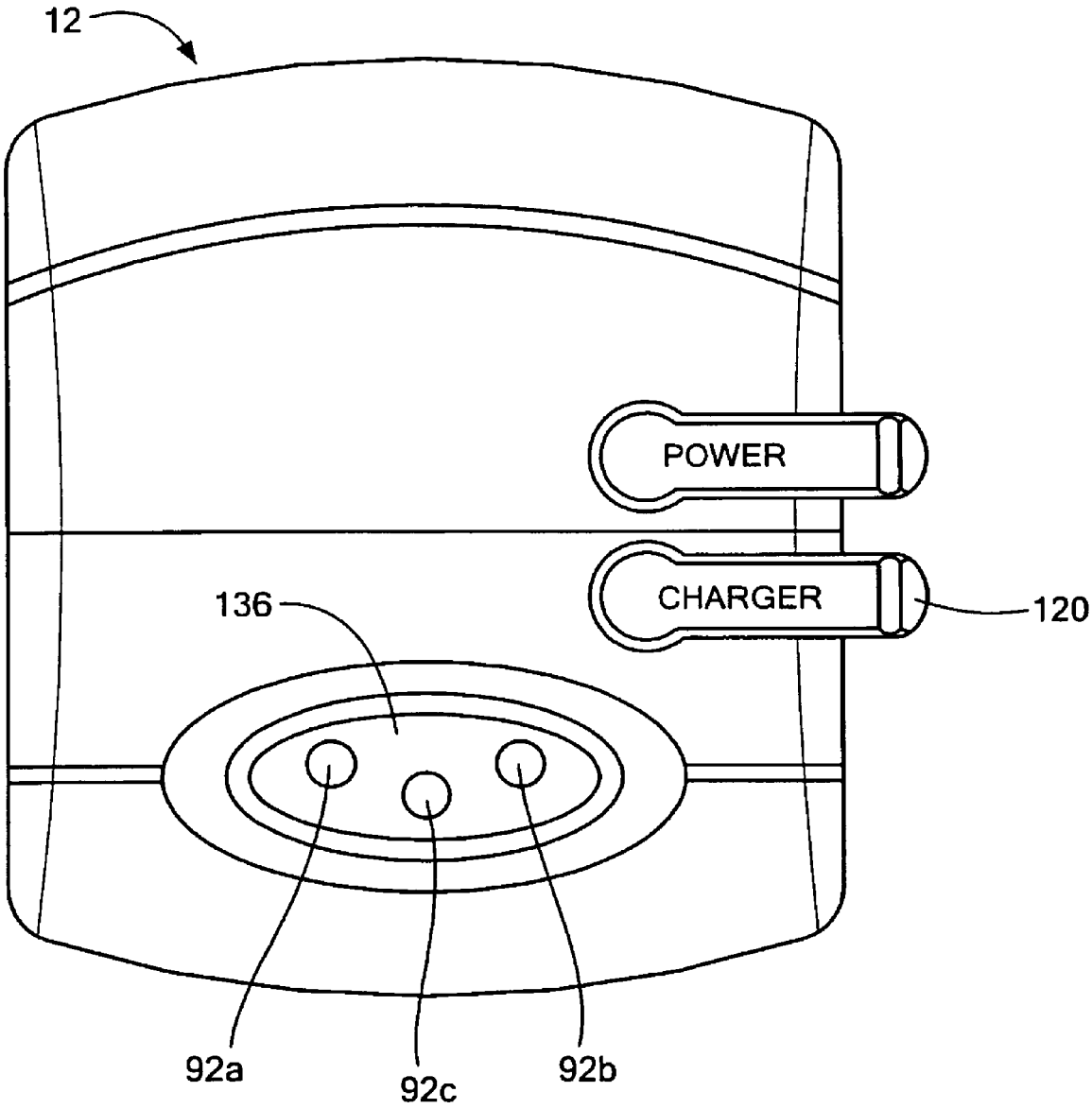
FIG. 11 is a schematic front view of an example of a power pack in accordance with the subject invention.

FIGS. 2 and 3 show buttons 70*a* and 70*b* which control LED 40. Dimmer button 70*a* toggles between three levels of illumination for the LED (low, medium, and high). Dimmer button 70*a* also controls switching of rearward facing LEDs 92*a* and 92*b*, FIG. 8 and programming for rechargeable battery. Lens 136, FIG. 11 is backlit with LED 92*c* which indicates charging status. On/Off button 70*b*, FIG. 3 turns the LED on and off. Buttons 70*a* and 70*b* are also backlit and change color to indicate battery life.

Figure 4:
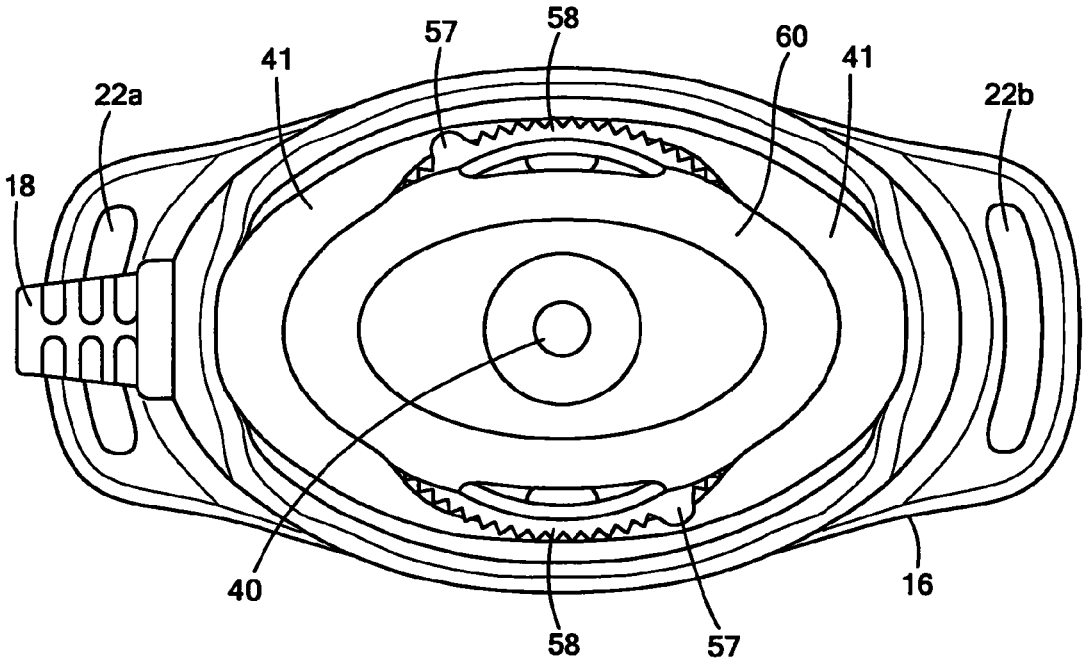
FIG. 4 is a schematic front view showing the lighting system of FIG. 1.
Figure 5:
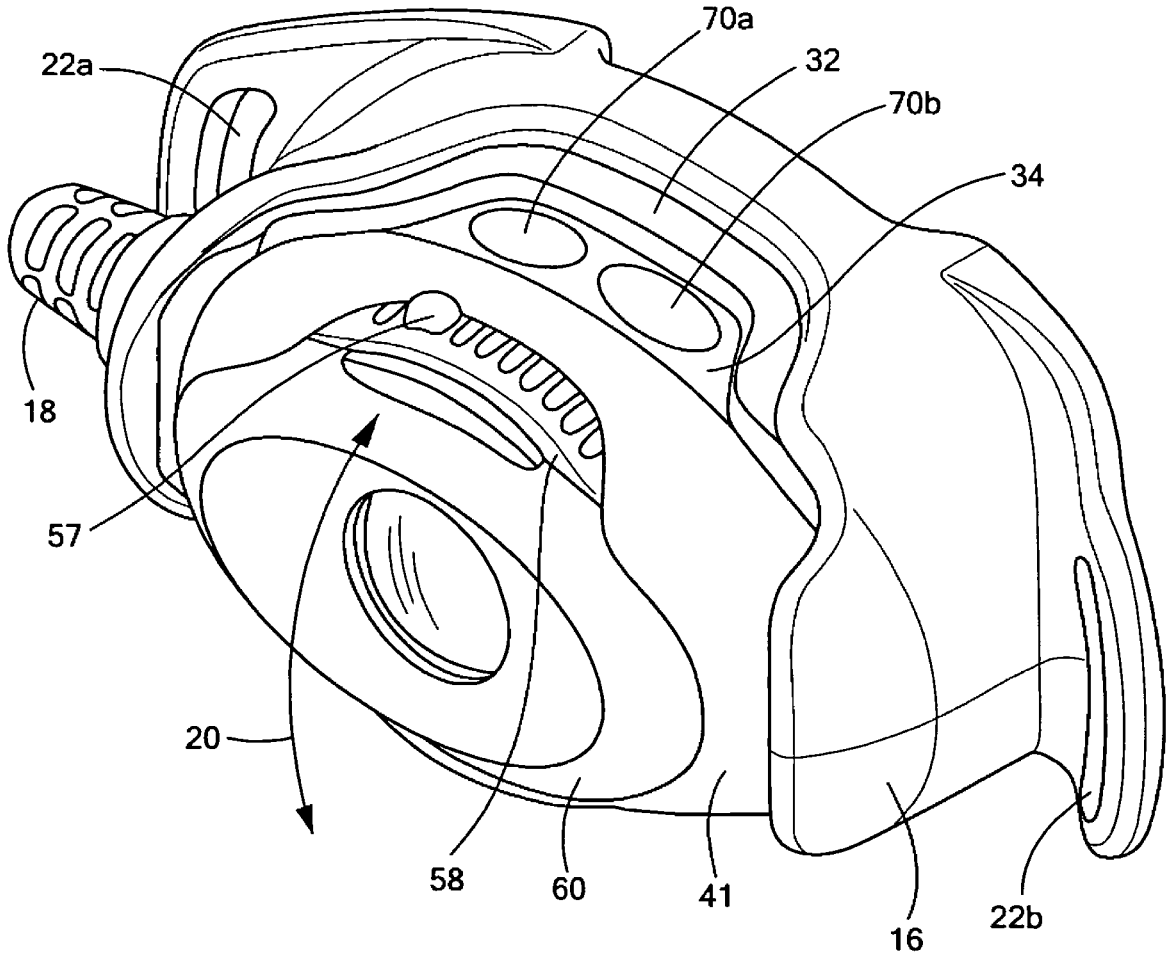
FIG. 5 is a schematic perspective front view of the lighting system of FIG. 1.
Figure 6:
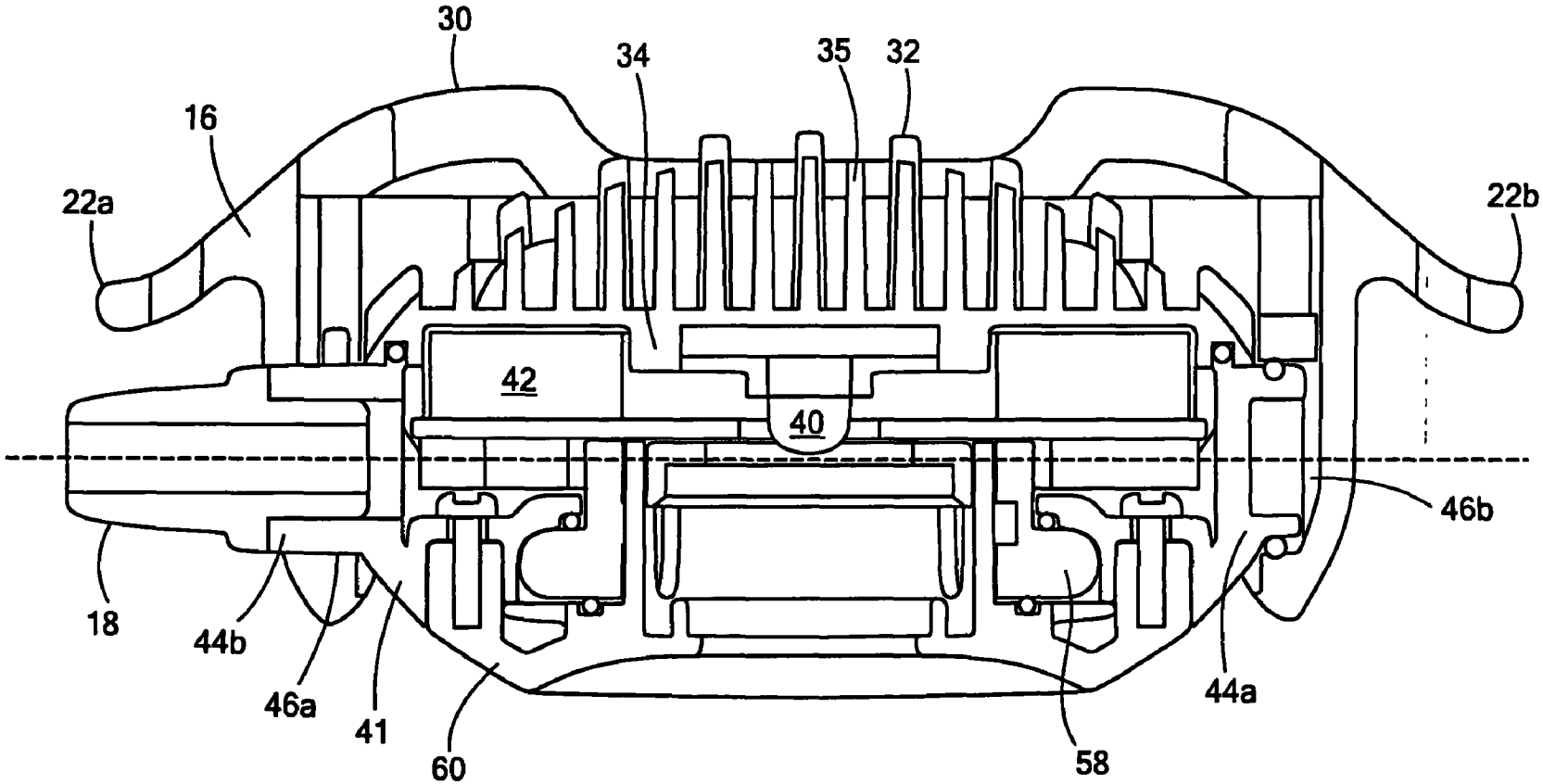
FIG. 6 is a schematic top partially cut-away view of the lighting system of FIG. 1.

FIGS. 4 and 5 show dial 58 which can be turned clockwise and counter-clockwise to increase or decrease the size of the beam produced by LED 40. FIG. 5 shows how cover 41 with bezel 60 pivots in housing 16 in the directions shown by arrow 20. FIG. 6 shows heat sink 34 and molded rearward fins 35.

Figure 7:
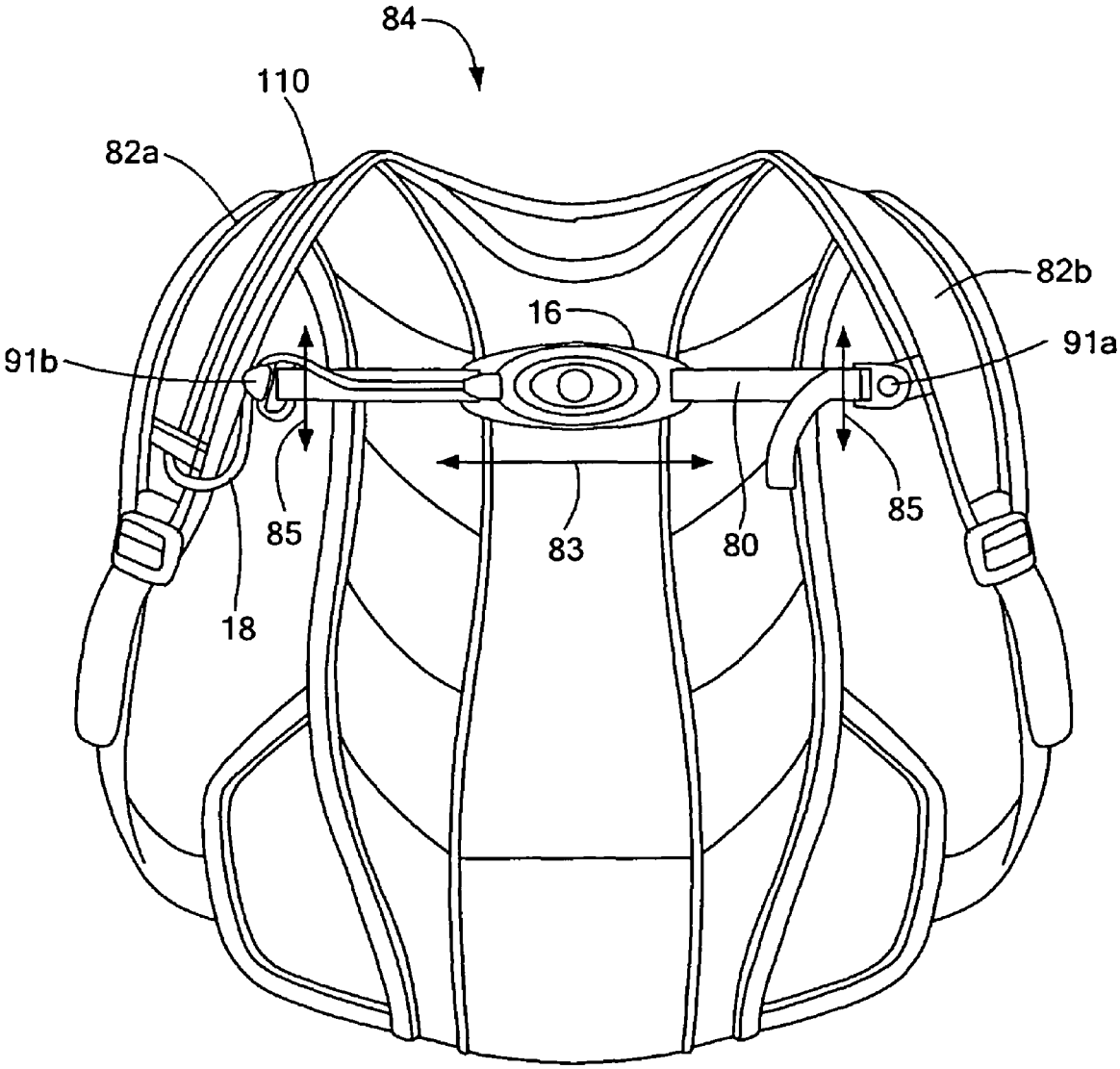
FIG. 7 is a schematic front view of a torso-mounted vest in accordance with the subject invention.

Housing 16, FIG. 7 can be attached to the body via adjustable sternum strap 80 extending between shoulder straps 82*a* and 82*b* of vest 84. Buckles 91*a* and 91*b* affix sternum strap 80 between the shoulder straps and allow for adjustment of housing 16 as shown by arrow 85. The rearward portion of vest 84, FIG. 8 includes pouch 90 with window for power pack 12 including integral rearward facing blinking LEDs 92*a* and 92*b* for safety. LED 92*c* is the power pack charging indicator.

Figure 10:
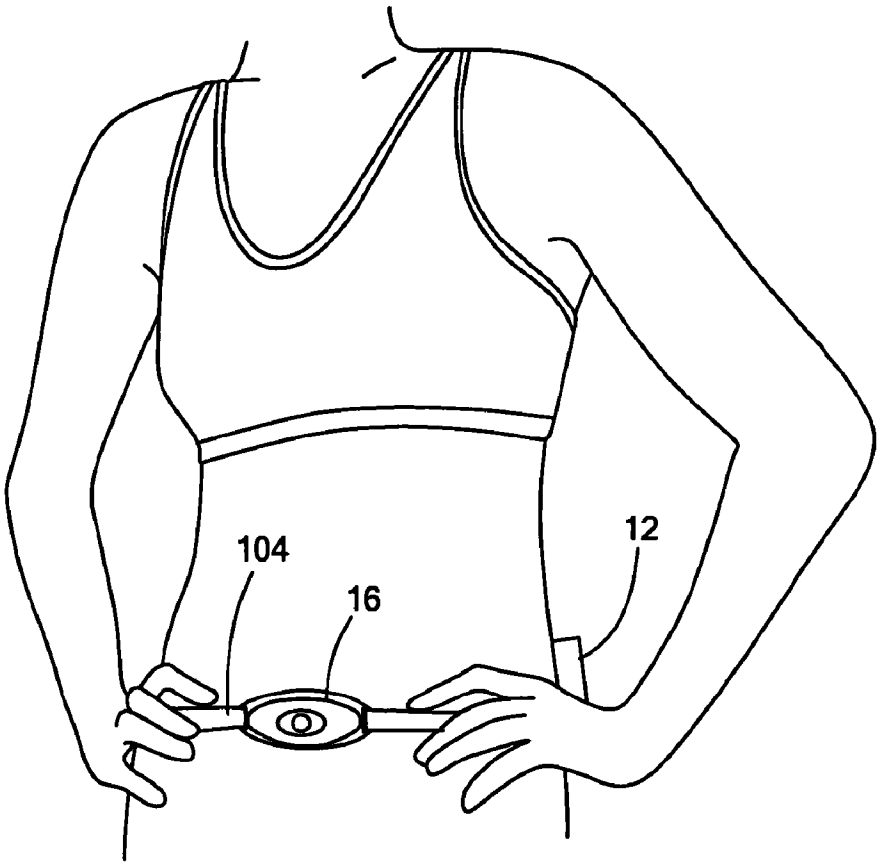
FIG. 10 is a schematic front view of a lighting system in accordance with the subject invention attached to a belt.
Figure 9:
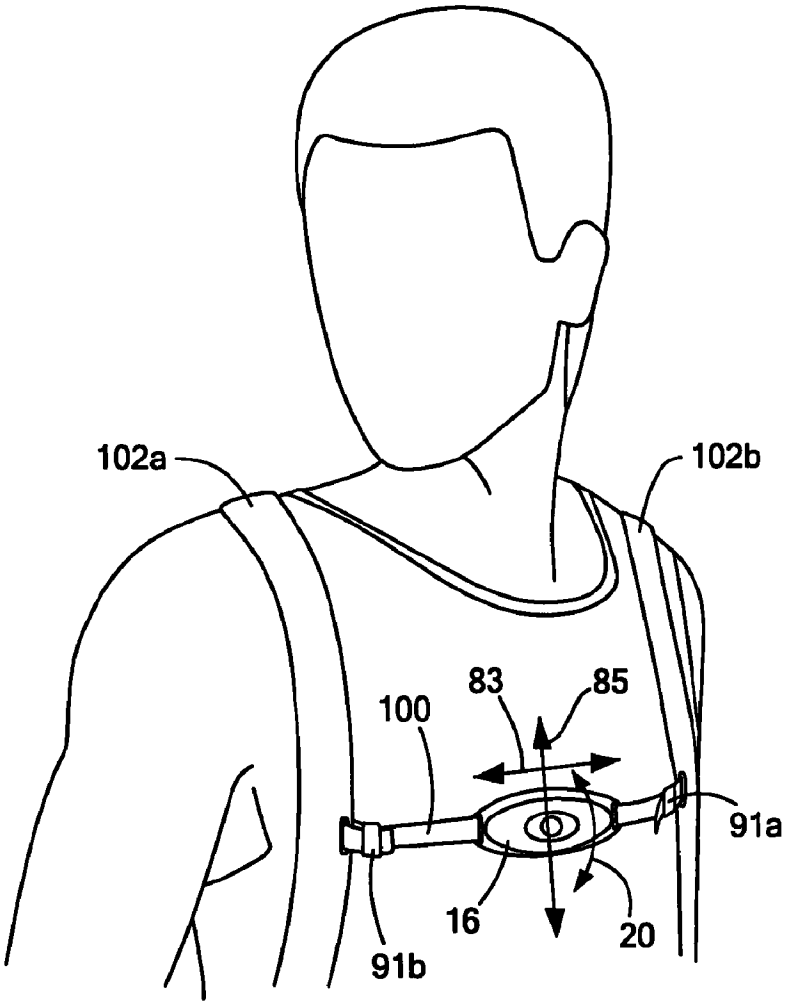
FIG. 9 is a schematic front view of a lighting system in accordance with the subject invention attached to the shoulder straps of a pack.

FIG. 9 shows strap 100 carrying housing 16 and attached to existing backpack shoulder straps 102*a* and 102*b*. FIG. 10 shows housing 16 mounted to belt 104 about the operator's waist. Power pack 12 can be mounted on belt 104 in a rear pouch. Each of the mounting methods can be adjustable in multiple dimensions to provide comfortable mounting to the body as shown by arrows 83 and 85. Within the plurality of harnesses available for mounting housing 16 to a person's body, power pack 12, FIG. 1 can be rearwardly mounted in order to display blinking LEDs for safety. Additionally, vest 84, FIG. 7 conveniently includes channel 110 in strap 82*a* for power cord 18.

In one example, power pack 12, FIG. 1 has terminal 120. Terminal 120, FIG. 11 allows a cord to be plugged in for recharging the batteries within power pack 12. Rearwardly mounted blinking LEDs 92*a* and 92*b* on power pack 12 provide rearward lighting for visibility from behind. LED 92*c* indicates charge status of batteries 132. LEDs 92*a*, 92*b*, and 92*c* may be powered by batteries 132 or by individual integrated batteries.

Figure 12:
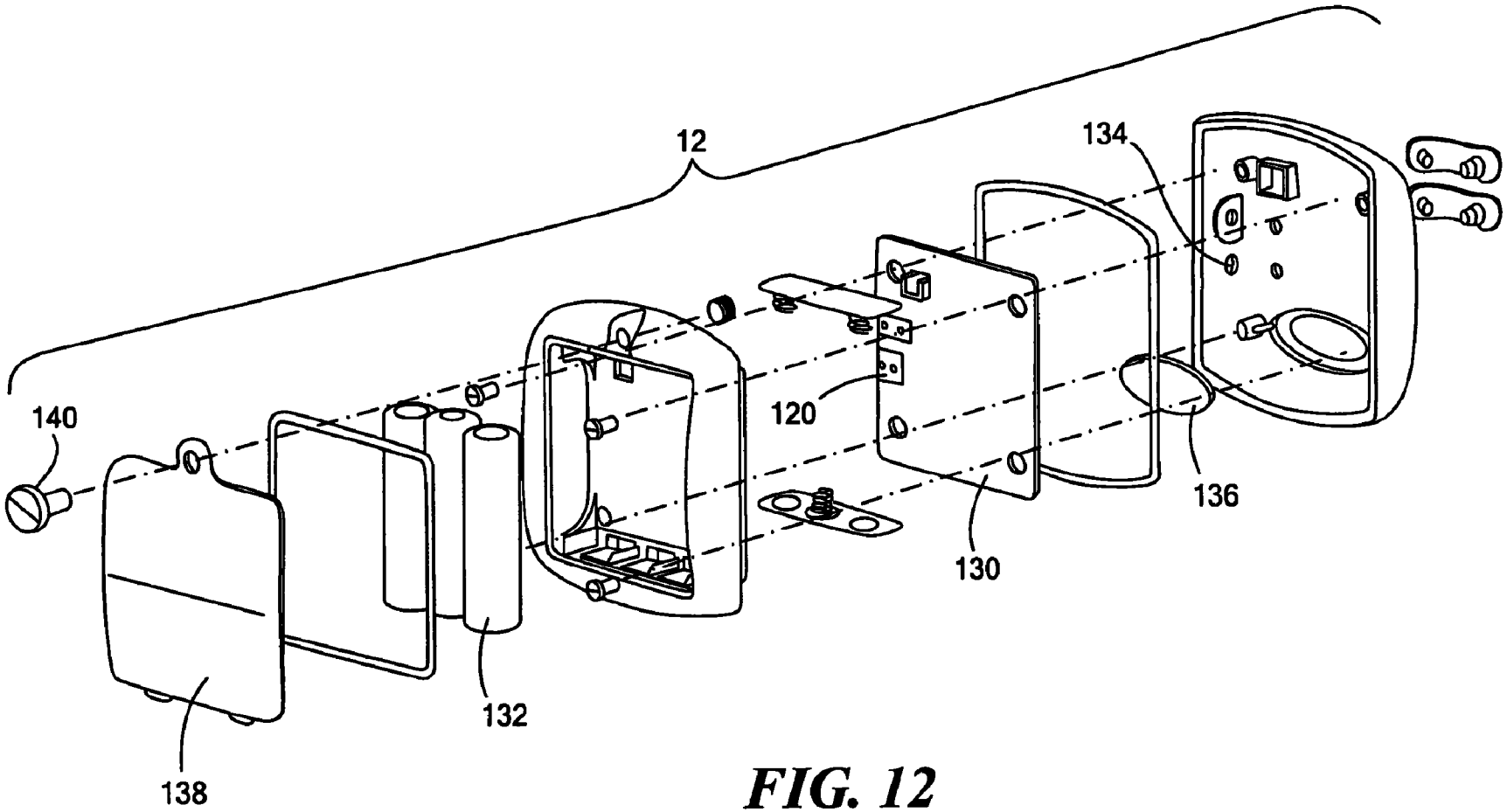
FIG. 12 is a schematic exploded view of the power pack shown in FIG. 11.

Power pack 12, FIG. 12 includes printed circuit board (PCB) 130 on which rearward facing LEDs (not shown) are mounted to provide visibility of the operator. Batteries 132 are located within the power pack and provide power to illuminate LEDs 40, 92*a*, 92*b*, and 92*c* of lighting system 10. Terminal 120 is located on power pack circuit board 130 and accessed through hole 134. Power pack lens 136 sits within the power pack and provides protection for rearward facing LEDs 92*a*, 92*b*, and 92*c*. Door 138 keeps batteries 132 within the power pack using screw 140 to secure door 138 to the power pack.

Although specific features of the invention are shown in some drawings and not in others, however, this is for convenience only as each feature may be combined with any or all of the other features in accordance with the invention. Moreover, the words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

The invention claimed is:

1. A versatile, low profile, lightweight, compact body mounted lighting system comprising: a housing including spaced strap slots for mounting the housing to a person's body via a strap extending through the spaced strap slots; an LED module in the housing, the LED module including: a cover pivotably mounted to the housing, at least one LED assembly coupled to the cover and including at least one LED, a lens in a lens carrier moveably mounted to the cover and configured to adjust the distance between the lens and the LED to vary the size of the beam; and in which the cover includes a power cord for the LED module extending through the housing and into the LED assembly and constituting a hinge between the housing and the cover.

2. The lighting system of claim 1 in which lens carrier resides in a focus dial rotatable to adjust the distance between the lens and the LED.

3. The lighting system of claim 1 in which the LED module further includes a rearward heat sink and the LED assembly is mounted to the heat sink.

4. The lighting system of claim 3 in which the heat sink is a polymer body with molded rearward fins.

5. The lighting system of claim 1 further including a power pack connected to the power cord.

6. The lighting system of claim 5 in which the power pack includes at least one rearward facing blinking light.

7. The lighting system of claim 1 further including a plurality of harnesses for mounting the housing to the person's body including:

a strap carrying the housing and securable to the shoulder straps of a pack, a strap carrying the housing and securable to a belt, and a vest including shoulder straps with a sternum strap therebetween carrying the housing.

8. The lighting system of claim 7 in which the sternum strap is adjustable with respect to the shoulder straps.

9. A versatile, low profile, lightweight, compact, body mounted lighting system comprising:

a housing including spaced strap slots for mounting the housing to a person's body via a strap extending through the spaced strap slots; and an LED module in the housing, the LED module including:

a cover pivotably mounted to the housing, at least one LED assembly coupled to the cover and including at least one LED providing a beam, a lens in a lens carrier movably mounted to the cover via a focus dial and configured to adjust the distance between the lens and the LED to vary the size of the beam, and a power cord for the LED extending through the housing and into the cover and constituting a hinge between the housing and the cover.

* * * * *